United States Patent [19]

Moscrip

[11] 4,084,480

[45] Apr. 18, 1978

[54] LIGHTWEIGHT SMALL CRAFT GUN SYSTEM

[75] Inventor: William Matthew Moscrip, King George City, Va.

[73] Assignee: The United States of America as represented by the Secretary of the Navy, Washington, D.C.

[21] Appl. No.: 606,906

[22] Filed: Aug. 20, 1975

[51] Int. Cl.[2] ..... F41F 19/14

[52] U.S. Cl. ..... 89/42 B; 89/33 MC; 89/43 A; 89/157

[58] Field of Search ..... 89/1, 818, 33 MC, 33 B, 89/42 B, 43 R, 43 A, 155, 156, 157

[56] References Cited

U.S. PATENT DOCUMENTS

| | | | |
|---|---|---|---|
| 2,192,677 | 3/1940 | Hoagland et al. | 89/33 B |
| 2,965,001 | 12/1960 | Bobco et al. | 89/155 |
| 3,262,367 | 7/1966 | Martwick et al. | 89/33 MC |
| 3,331,283 | 7/1967 | Piskator et al. | 89/42 B |
| 3,501,998 | 3/1970 | Dardick | 89/156 |
| 3,598,016 | 8/1971 | Chiabrandy et al. | 89/43 A |
| 3,919,918 | 11/1975 | Rudman | 89/42 B |

*Primary Examiner*—Stephen C. Bentley

[57] ABSTRACT

An automatic gun firing expendable breechcase ammunition having a receiver reciprocably mounted in a trunion-mounted, slide assembly and having the barrel fixed thereto to comprise the recoiling mass. Two pairs of trifurcated members are disposed within the receiver and rotatable on axes parallel to the firing axis for receiving ammunition from a clip feed mechanism, supporting each breechcase during firing and subsequently ejecting the empty breechcases. Cam mechanism interconnects the receiver and slide assembly and cycle the trifurcated members as the receiver moves in recoil and counterrecoil. A liquid spring system provides a substantially constant force to drive the receiver toward the maximum out-of-battery position and to oppose recoil and a laser system is provided to fire the gun as the receiver approaches the maximum out-of-battery position whereby forward momentum of the receiver overcomes part of the recoil force produced by the firing impulse.

5 Claims, 18 Drawing Figures

*INITIAL POSITION* (IN BATTERY)

*COUNTER RECOIL*

*RECOIL* (FIRING POSITION, OUT OF BATTERY)

*FINAL POSITION*

LIGHTWEIGHT SMALL CRAFT GUN SYSTEM

BACKGROUND OF THE INVENTION

This invention relates to automatic guns and more particularly to a new lightweight gun system to serve as the main armament of naval combatant small craft.

An urgent need exists within the Navy for new and effective but lightweight weapons systems, for application to surface ships in general and for arming a new generation of naval combatant small craft in particular. A specific requirement is for a more lightweight, accurate, and lethal armament which can provide both surface-to-surface and surface-to-air capability in the destruction of a large variety of targets. At the present time there appears to be no existing gun system, missile system, or hybrid weapon system which exhibits the necessary performance characteristics to adequately satisfy this requirement, yet still is small enough and light enough to fit the small craft platform. The excessive size, weight, and recoil forces of existing high performance weapon systems preclude their use on small craft.

SUMMARY OF THE INVENTION

The invention comprises fundamental concepts and mechanical components which are combined to form a new lightweight gun system, specifically including the following: (1) an exceptionally lightweight and elegantly simple expendable breech gun mechanism with a unidirectional feed system; (2) an advanced fire-out-of-battery recoil system employing a unique servo-controlled liquid recoil spring; (3) the application of high strength filamentary composite materials to breechcase construction; (4) the utilization of advanced interior ballistics concepts to achieve optimum piezometric efficiency and maximum reproducibility in the firing impulse; and (5) a lightweight and fully automatic gun mount which incorporates space-age isogrid structural design technology. Integration of these concepts with a modular solid state, electro-optical, gun fire control system and a new family of ammunition including advanced projectile guidance, fuzing, and warhead concepts comprises the scope of the present invention.

This system, designated the LSCGS or Lightweight Small Craft Gun System, is intended to provide the new generation of advanced fast patrol craft, hydrofoils, and surface effect ships with an all-weather multi-purpose weapon system having the most effective firepower possible from the smallest and simplest total system. The LSCGS represents a unique and completely new approach to gun system design, embodying a multitude or new and imaginative ideas in its conception. It can be expected to display significant superiority over all other known small craft gun systems on the strength of its exceptionally low total system weight alone, although it exhibits numerous other pertinent advantages. This characteristic may make possible for the first time the installation of a medium caliber (3-inch or larger) gun on small craft normally able to accomodate only small caliber (20mm– 40mm) machine guns. Such a gun system may also find important application as the secondary armament of larger surface vessels, the main armament of future amphibious craft, and even in gunship aircraft programs due to its lightweight modular construction.

STATEMENT OF THE OBJECTS OF THE INVENTION

It is a primary object of this invention to provide a new and improved lightweight automatic medium caliber gun system.

It is another object of this invention to provide an automatic gun system utilizing fire out of battery principles to reduce the recoiling mass.

It is a further object of this invention to provide an automatic gun system capable of firing expendable breechcase ammunition.

It is yet another object of this invention to provide an automatic gun system having a substantially constant force recoil system.

It is a still further object to provide an automatic gun system capable of firing either high or low velocity ammunition.

BRIEF DESCRIPTION OF THE DRAWINGS

Other objects, advantages and novel features of the invention will become readily apparent upon consideration of the following detailed description when read in conjunction with the accompanying drawings wherein.

DESCRIPTION OF THE PREFERRED EMBODIMENT

Figure 2:
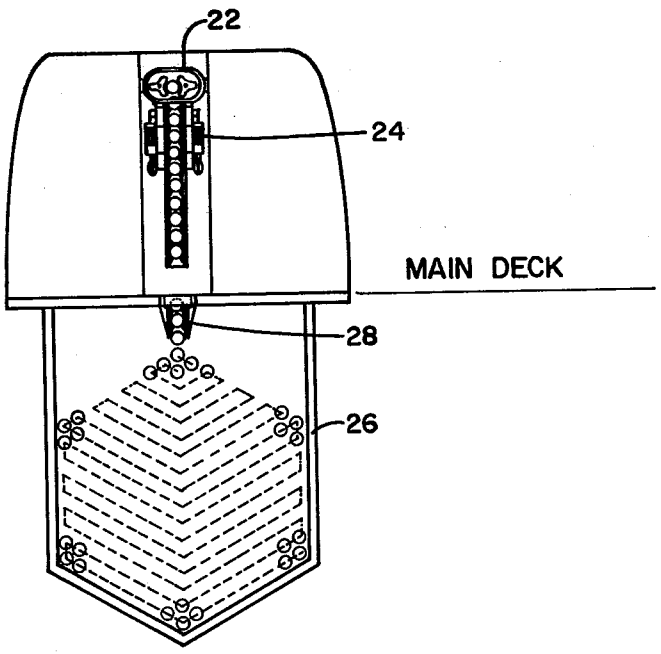
FIG. 2 is a front view of the gun system of FIG. 1 illustrating the magazine and ammunition feeding mechanisms.
Figure 1:
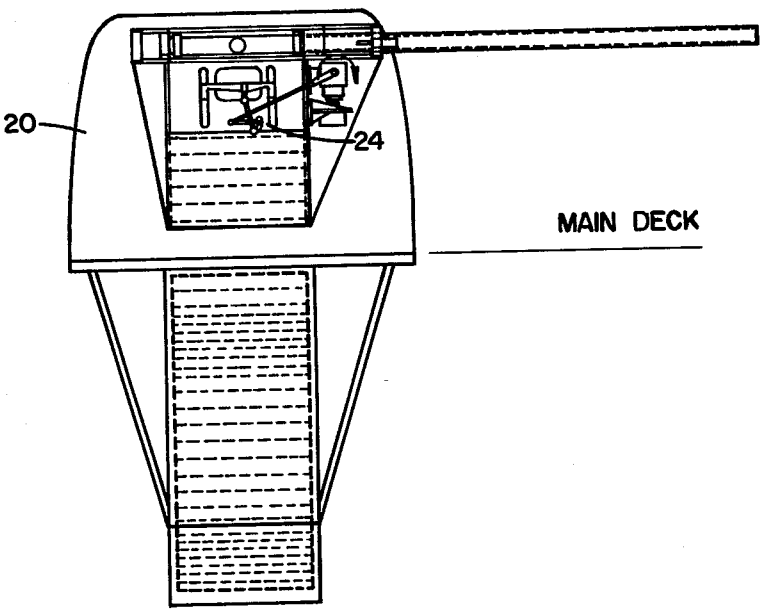
FIG. 1 is a side elevation of the general arrangement of the gun system of the present invention.

Attention now is directed to the drawings, wherein like numerals of reference designate like parts throughout the several views, and more particularly to FIGS. 1 and 2 in which the general arrangement of the gun system is illustrated. A gun turret 20 has mounted therein a gun mechanism designated generally by reference numeral 22 with a clip feed mechanism 24 depending therefrom. A magazine 26 and magazine feed mechanism 28 are suspended below the turret 20 and movable therewith in train.

The present invention is an effective synergistic combination of both old and new ideas in ordnance technology. At the time the invention was first conceived, there existed a need within the Navy for increased fire power for riverine warfare craft. Consequently, the description of the ammunition which follows is directed toward a type of ammunition which will permit minimization of the total weight of the entire gun system. However, the principles of operation of the invention are obviously equally applicable to the firing of high velocity ammunition.

The choice of a low velocity, low pressure gun producing muzzle velocities on the order of 1000–1400 ft/sec was desirable from the standpoint of a low total system weight. Lower chamber pressures permit a reduction in the material wall thickness of the breechcase and the barrel which directly reduces the total system weight. Lower velocities are accompanied by lower recoil mount structure, a major component of the total system weight. Thus if a low velocity gun is used to launch a rocket assisted projectile, it is possible to achieve an optimal tradeoff between low recoil forces and total system weight on the one hand and a desired final velocity for a given projectile weight on the other.

But low velocity, low pressure guns are subject to inherent propellant ignition difficulties, presumably because the pressure builds up slowly and the burning rate is a complex function of the pressure. This in turn results in relatively large round to round variations in muzzle velocity which adversely affect the accuracy of the gun and complicate the design of the recoil system. For these and other reasons the initial prototype design of the gun for the LSCGS was based on high/low pressure interior ballistics.

The high/low interior ballistics principle was developed by the Germans in WWII to eliminate the erratic propellant burning characteristics of low pressure guns. It represents a major advance in the design of such guns because it permits the propellant to be burned effectively at a high pressure, while discharging the projectile with an exceptionally reproducible low pressure pulse. This is normally accomplished by interposing an orifice plate between the propellant charge and the projectile, forming two chambers. By proper choice of propellant and orifice area a desired high/low pressure differential is established in which the burning of the propellant within the high pressure chamber proceeds independently of conditions in the bore, or low pressure chamber, as long as the flow of propellant gases through the orifice is sonic. This condition is met in most practical systems whenever the ratio of the low pressure over the high pressure is less than or equal to 0.55.

Figure 3:
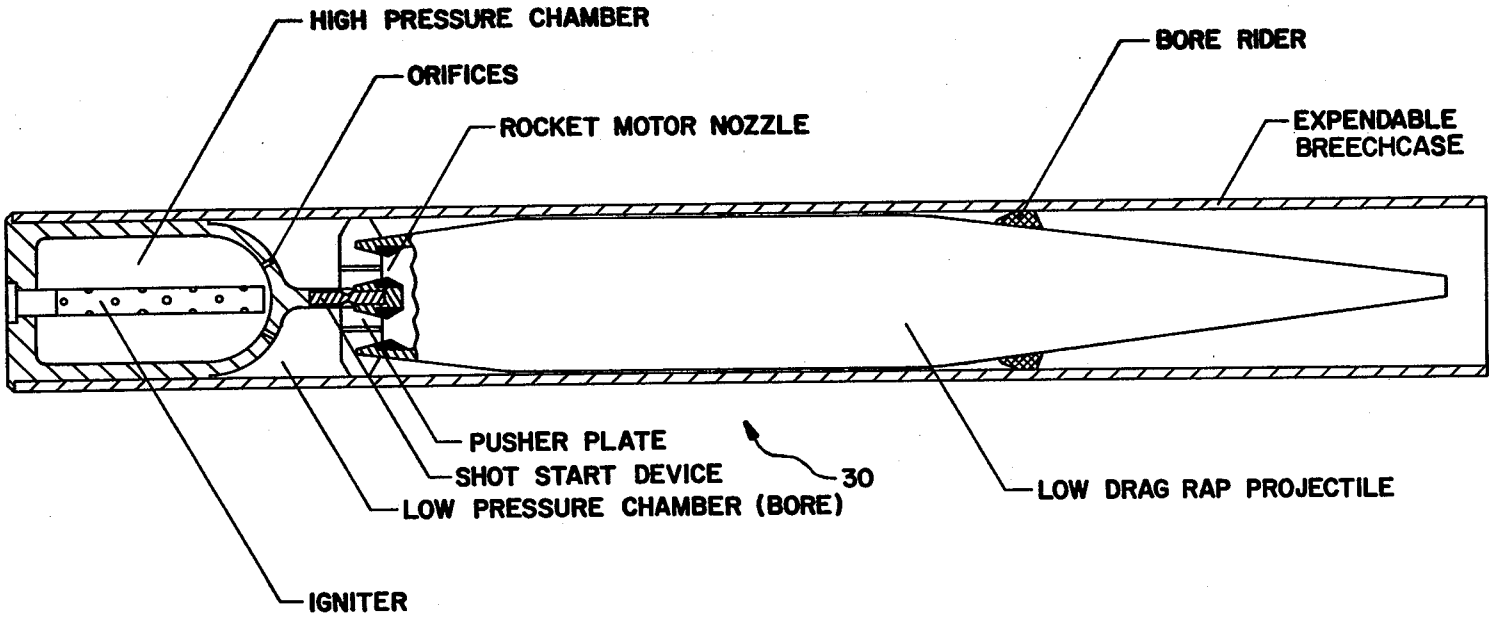
FIG. 3 illustrates one type of expendable breechcase ammunition usable in the present invention.
Figure 4A:
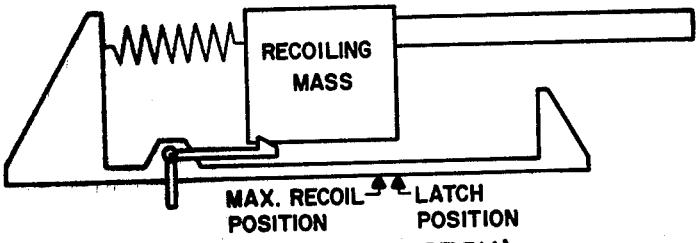
FIGS. 4(*a*)–4(*d*) schematically illustrate the fire-out-of-battery recoil cycle utilized in the present invention.
Figure 4B:
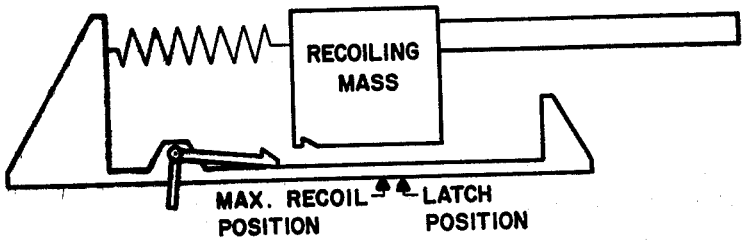
Figure 4C:
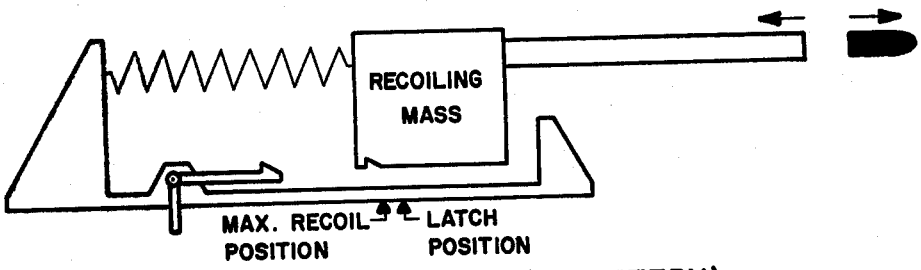
Figure 4D:
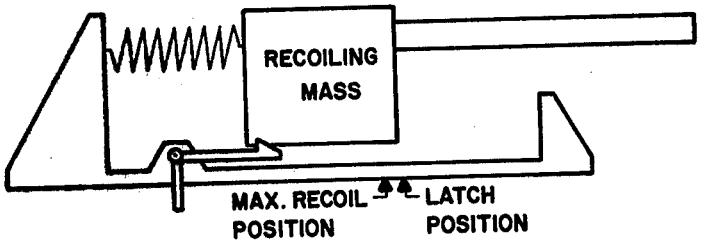

The design of a high/low system for the ammunition 30 is shown in FIG. 3. This system is designed for a peak high pressure of 50,000 psi and a peak low pressure of 10,000 psi, resulting in a pressure ratio of 0.20. The projectile is ejected by the low pressure pulse through a rifled gun tube having a one-in-twelve gain twist. The rifling torque is transmitted to the projectile through the pusher plate which is keyed within the diffuser cones of the projectile rocket motor nozzles. The RAP motor is ignited by hot propellant gases vented into the combusion chamber through two small orifices as the projectile travels down the bore. The pusher plate is detached and falls away as the projectile enters the free stream and the RAP motor achieves full ignition a short distance forward of the muzzle. The projectile rotating band is formed on the outer diameter of the pusher plate, and thus the projectile is designed with an optimum drag shape free of surface irregularities to achieve minimum transit time to the target and maximum effective range. This approach is also expected to result in a system which exhibits extended barrel life and produces very low muzzle blast overpressures.

In conventional gun mechanism operation a significant portion of the total cycle time is usually given over to ramming a round into the chamber, positioning and locking the breechlock behind the round, unlocking and repositioning the breechlock after firing, and extracting the spent case from the chamber. In an expendable breech gun the cartridge case is designed to be sufficiently strong to withstand maximum breech pressure without external support. Such a case can therefore take on the function of the conventional gun chamber, serving as a one-shot breech, provided an appropriate seal is maintained between the case and the barrel while firing.

As shown in FIG. 3, the expendable breechcase can be made in the form of a simple right cylinder which encloses both the projectile and the propellant chamber and is open at the forward end. In operation the expendable breech round is mechanically locked in allignment with the barrel, supported from behind, and fired electrically. The chief advantage of the expendable breech round arises from the fact that it can be positioned, fired, and ejected in a single feed direction, thus eliminating conventional ramming and extraction functions as well as the mechanisms required for their accomplishment. While significantly reducing the overall mechanical complexity of the gun mechanism, the expendable breech approach also tends to produce a higher rate of fire because the number of mechanical operations are reduced and therefore less time is required to cycle each round through the gun mechanism.

The peak chamber pressure of a conventional medium caliber gun is typically on the order of 50,000 psi. The force of the pressure accelerates the projectile toward the target, but it also acts in the opposite direction on the gun to produce recoil forces. In a conventional recoil system the peak recoil forces are held to a minimum by permitting part of the gun mechanism to move back against a controlled force over a given distance. This force is usually supplied by the combined action of a counterrecoil spring and a hydraulic dashpot, or recoil cylinder. The kinetic energy imparted to the recoiling mass by the firing impulse either is dissipated through viscous friction within the recoil cylinder or is stored within the counterrecoil spring. The stored energy of the spring then serves to return the recoiling mass to the battery position from the position of maximum recoil.

In the fire-out-of-battery (FOOB) recoil system, schematically illustrated in FIGS. 4(*a*)–4(*d*), the recoiling mass initially is latched in the battery position near the position of maximum recoil. At the beginning of a cycle the latch is released and, as in the conventional system, the recoil spring accelerates the recoiling mass forward. But in this case the gun is fired just before the maximum out-of-battery position is reached. The recoiling mass at this point possesses a certain forward momentum which opposes and nullifies a large portion of the firing impulse. If the forward momentum imparted to the recoiling mass prior to firing is equal in magnitude to one-half the momentum derived from the firing impulse, the magnitude of the resulting rearward momentum will be just enough to return the mass to the latch position while "re-cocking" the spring.

Under these circumstances the recoil velocity imparted to the recoiling mass of the FOOB system by the firing impulse is less than the recoil velocity attained by the recoiling mass of the conventional system. It follows that the recoil energy also is less, and therefore the force required to decelerate or stop the recoiling mass within a specified recoil displacement is significantly reduced by the FOOB system. This force is the brake load exerted by the gun on the mount structure. If a constant recoil spring force is applied and the magnitude of the force, recoiling mass, recoil distance, and firing impulse are the same for each system, it can be theoretically demonstrated that the brake load exerted by an ideal FOOB system is only ¼ the brake load exerted by an ideal conventional system. Since the size and strength of both the gun mount and the structure on which it is placed are functions of the maximum brake load to be supported, the FOOB recoil system can provide a significant reduction in the total weight of the gun system. In order to approach the theoretical ideal in a practical FOOB recoil system the present invention utilizes an essentially constant force liquid recoil spring based on the compression properties of certain fluids, notably liquid dimethyl silicone. A simple liquid spring consists of a chamber filled with compressible liquid and a piston rod which moves into and out of the chamber through a high pressure seal. As more of the rod is pushed into the chamber, the space available for the liquid is reduced and the fluid pressure rises, increasing the force on the rod. The rate of increase in the force level of the spring per unit piston displacement is defined to be the spring rate of the spring. Liquid springs are unique in that the initial force on the rod can be varied through a wide range of values simply by precompressing the liquid in the chamber.

Ordinary liquid springs have rather large spring rates and develop high load capacities within comparatively small volumes. This characteristic has resulted in widespread use of liquid springs in aircraft, spacecraft, and military applications. A nearly constant force liquid spring, ie. one which has a relatively small spring rate, can be made by increasing the initial volume of compressible liquid relative to the volume displaced by the piston rod during the stroke. Although a truly constant force liquid spring would require a prohibitively large initial volume of liquid, a relatively small spring rate can be achieved within a relatively small initial volume because the spring rate of a liquid spring is a hyperbolic function of the volume. Preliminary calculations indicate that it is possible to construct a practical 4000 pound force liquid recoil spring which exhibits only 4% force variation over an 8-inch stroke using a spherical pressure vessel only 24 inches in diameter to contain the fluid.

Figure 5:
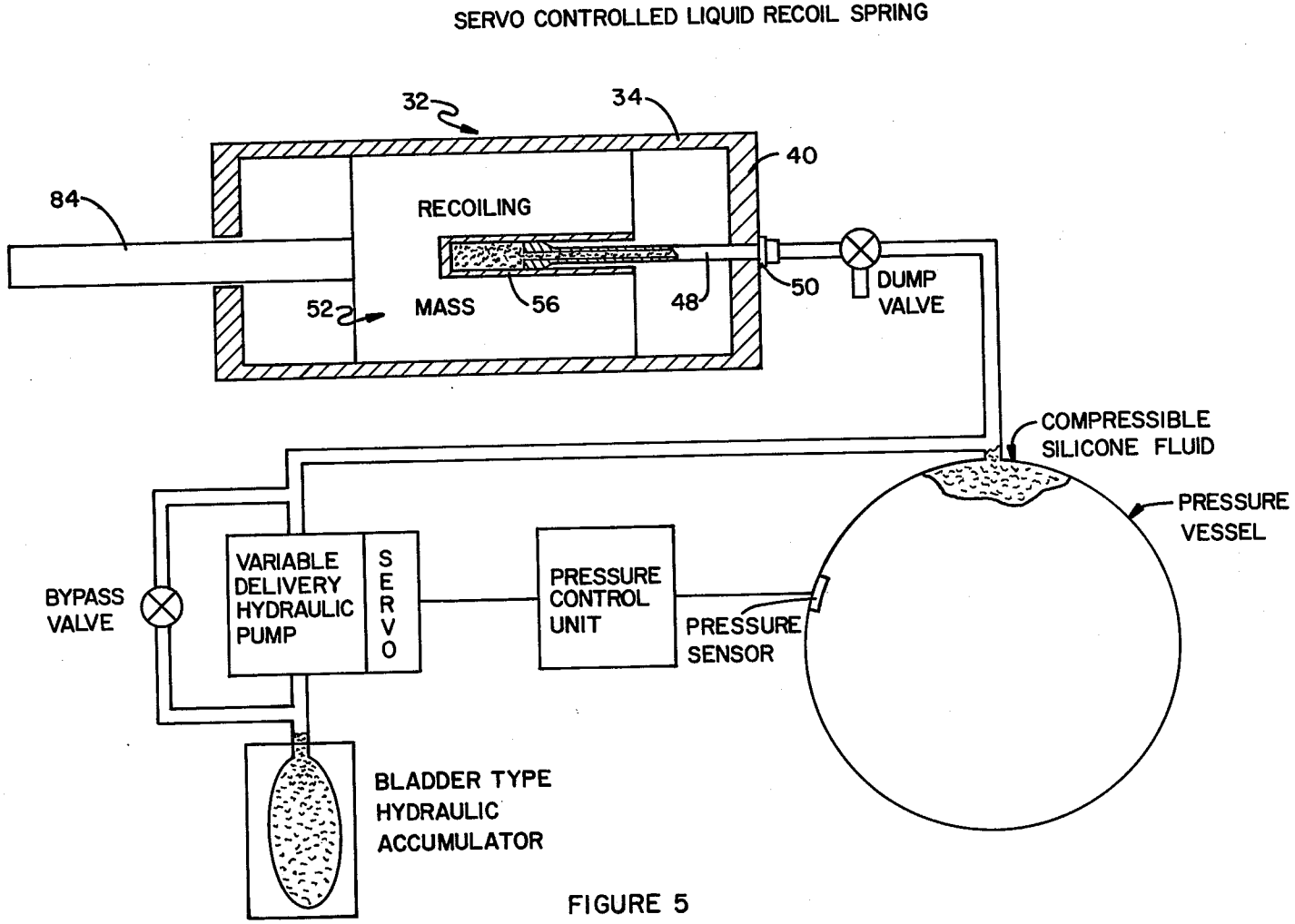
FIG. 5 is a schematic illustration of the substantially constant force liquid spring of the present invention.

As in ordinary liquid springs, the force level of a constant-force liquid recoil spring can be changed by adjusting the amount of initial fluid precompression. If a servo-controlled positive displacement hydraulic pump is employed for this purpose, simple but precise automatic control of the force applied to the recoiling mass of an FOOB recoil system becomes possible. This approach would permit the fire control computer to continually compensate for the effects of normal variations in the firing impulse, e.g. ambient temperature, elevation angle, etc. on the operation of the system. Thus a servo-controlled liquid spring provides a relatively simple solution to the seemingly complex problem of designing an automatic FOOB recoil system to function in the environment presented by a high speed maneuvering surface vessel. This concept is schematically illustrated in FIG. 5.

Figure 6:
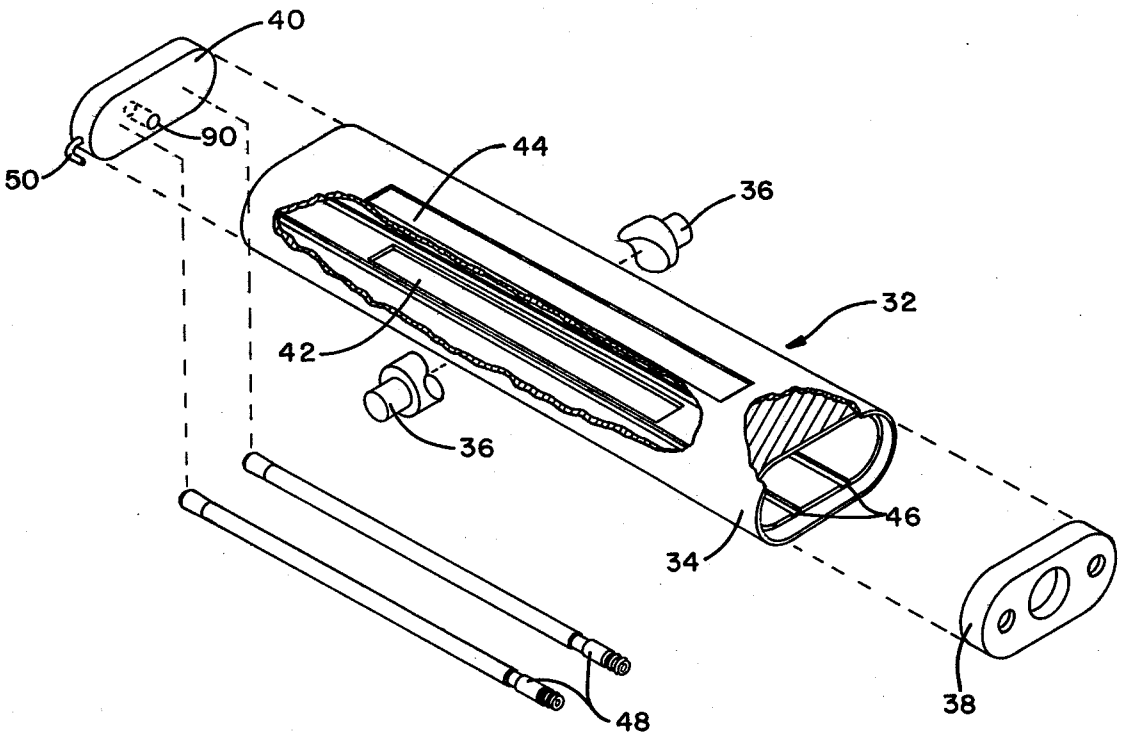
FIG. 6 is an exploded perspective view illustrating the principal components of the slide assembly.

The gun mechanism consists of three principal components: a slide assembly, a receiver assembly, and a breechcase mechanism assembly. The slide assembly 32 is illustrated in FIG. 6. The slide is a steel casing 34 which contains, positions, and provides working surfaces for the other parts of the gun mechanism. It has a pair of trunnions 36, a front faceplate 38, a rear faceplate 40, a feed port 42, and an ejection port 44. In addition, the bearing surfaces 46 which support the receiver and the cam surfaces (not shown) in this view) which actuate the breechcase mechanism assembly are milled on the interior surface of the slide. A pair of hollow pistons 48 are fixed to the rear faceplate 40 and project into the interior of the casing 34. Internal porting (not shown) hydraulically connects the rearward ends of the pistons 48 to an external fitting 50.

Figure 7:
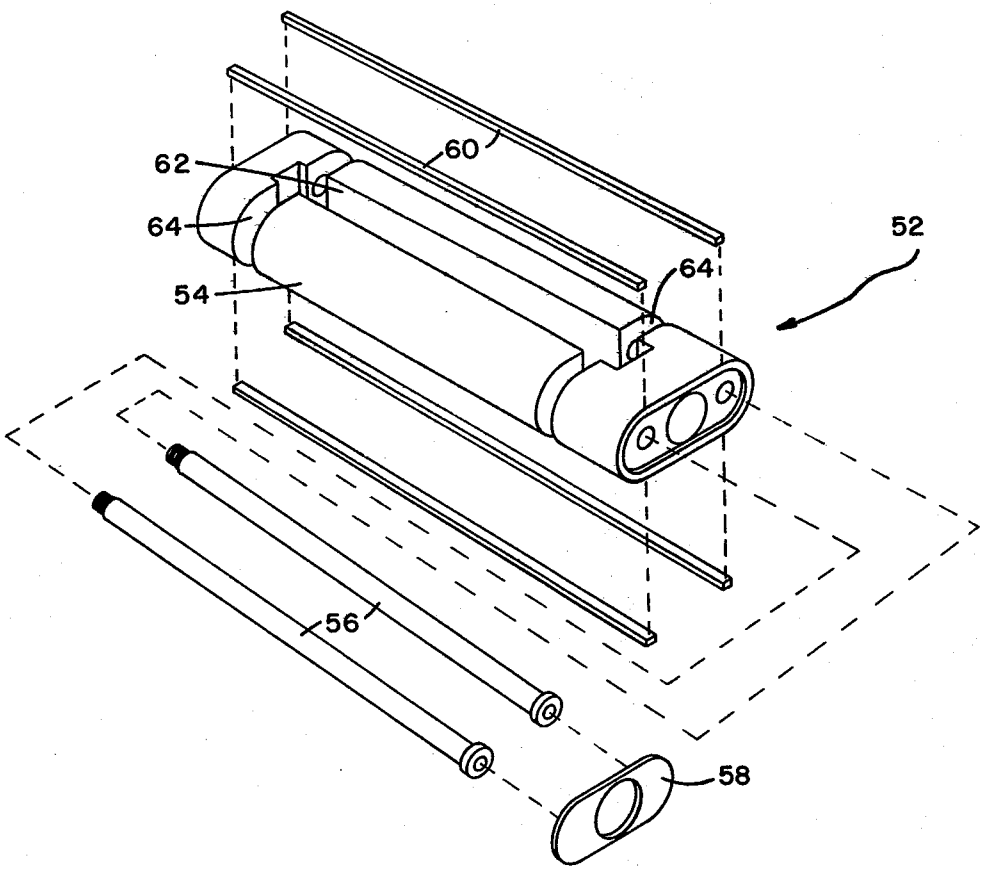
FIG. 7 is an exploded perspective view illustrating the principal components of the receiver assembly.

The receiver assembly 52, as shown in FIG. 7, is principally made up of five components: a receiver 54, the barrel, two hollow breechcase mechanism shafts 56, and a locking plate 58. These parts, together with those of the breechcase mechanism assembly, comprise the recoiling mass of the system. The receiver is supported within the slide on rollers 57 and 59 (FIG. 8) mounted in bearing strips 60. These strips extend the entire length of the receiver and together with spaced pairs of rollers constrain its motion in recoil to one dimension, i.e. along the firing axis. When the receiver assembly is within the slide assembly 32, the hollow pistons 48 are disposed within the hollow breechcase mechanism shafts 56.

A vertical channel 62 defining a feed slot is cut through the body of the receiver and serves to guide the breechcase into and out of firing position. The forward surface of the feed slot, the breechfase, contains the after end of the barrel. The barrel is held in the receiver 54 by means of a conventional keying mechanism (not shown) and is maintained in this position by the locking plate 58.

Two transverse channels 64 are cut through the sides of the receiver 54 and extend into the feed slot 62. These channels 64 are designed to accommodate the four mechanisms of the breechcase mechanism assembly which lock the breechcase in firing position and eject it during recoil. These mechanisms are mounted in pairs on each breechcase mechanism shaft 56 and rotate about the shafts during the feed and ejection cycles. The breechcase mechanism shafts, like the barrel, are locked in a fixed position with respect to the receiver 54 by the locking plate 58.

Figure 8:
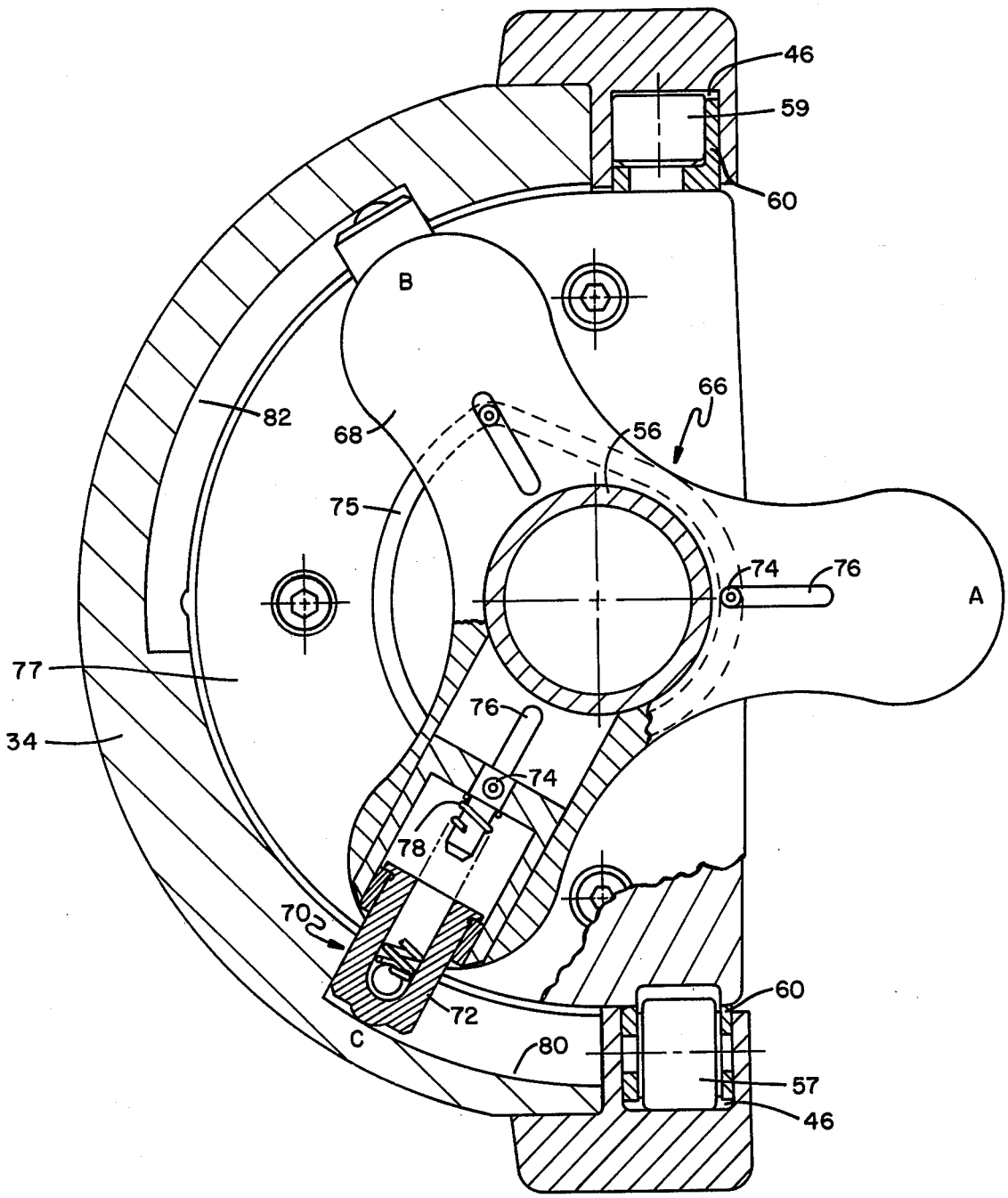
FIG. 8 is a partially sectional view of one trifurcate breechcase mechanism illustrating the details of construction.

The design of a single breechcase mechanism assembly 66 is shown in FIG. 8. Each mechanism is a trifurcated steel housing 68 which contains a spring loaded cam follower assembly 70 within each arm. The rotation of the breechcase mechanism assembly 66, and therefore the feed and ejection of the breechcase, is determined by the position of the roller followers 72 within cylindrical groove cams 80 and 82 (see also FIG. 9) machined in the slide 34. This position changes in a prescribed manner as the receiver moves relative to the slide in counterrecoil and recoil. A dowel pin 74 forms a part of each cam follower assembly 70. The pins 74 are disposed in slots 76 formed in each arm and project beyond the surfaces of each arm. The pins 74 are engaged by grooves 75 in cam plates 77 disposed in the transverse channels 64 in receiver 54 and serve to extend from or retract into the arm of the breechcase mechanism 66 the cam follower assembly 70; depending upon the angular position of the mechanism 66 relative to the shaft 56. The cam follower assemblies 70 are also designed so that the roller followers 72 can be retracted into the arm even though the pin 74 is in an extended position relative to the shaft 56. A compression spring 78 provides the force required to extend the rollers 72 whenever they are permitted to do so.

Figure 9:
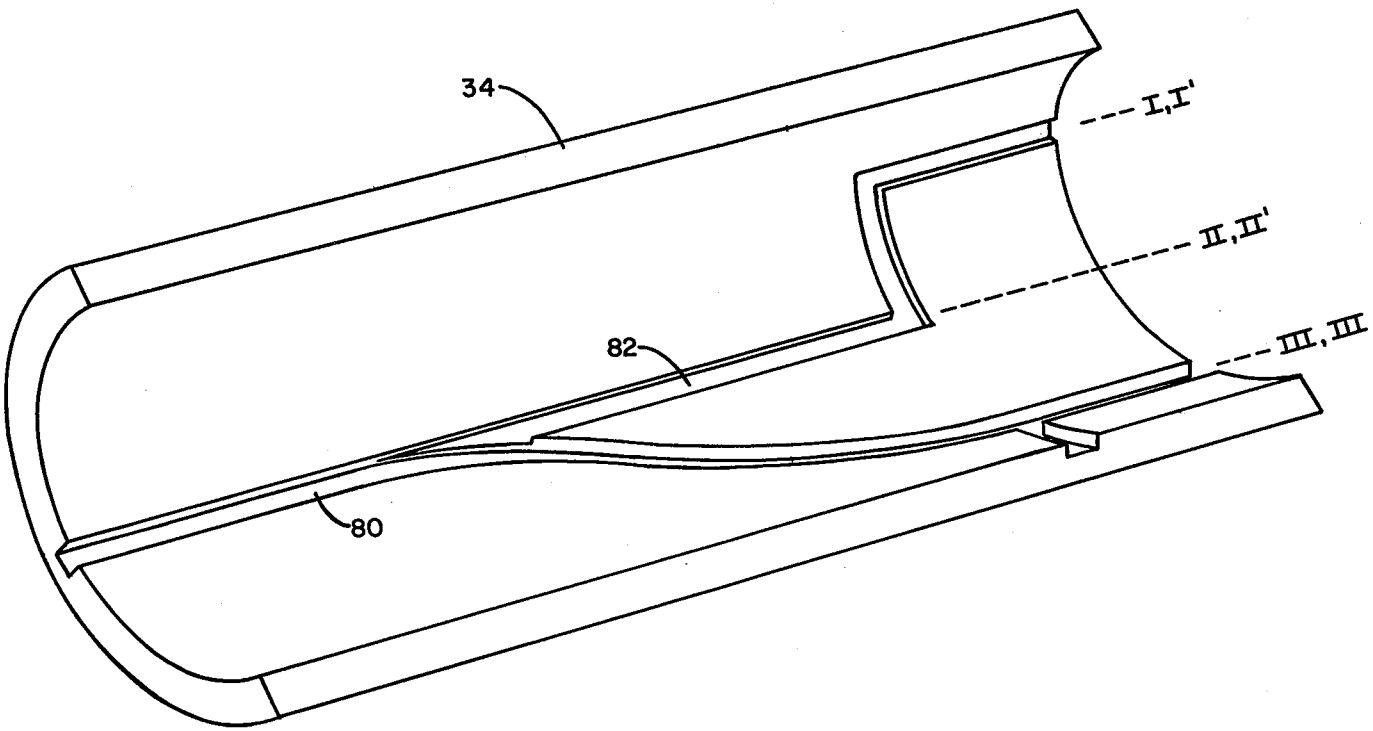
FIG. 9 is a perspective view of one of the cylindrical groove cams formed in the interior wall of the slide assembly.

An illustration of one of the cylindrical groove cams which is cut into the interior wall of the slide 34 is shown in FIG. 9. The depth of one portion 80 of the cam is greater than the depth of the rest of the cam 82. Thus the geometry of the cylindrical groove cams controls the motion of the rollers 72 in the radial direction as well as about the cylinder axis. This configuration together with the cam plates 77 in the receiver results in three primary assembly positions within the breechcase mechanism 66, indicated by the reference letters A, B and C in FIG. 8, which are assumed by each roller assembly 70 at various times during the operation of the gun mechanism.

Figure 10:
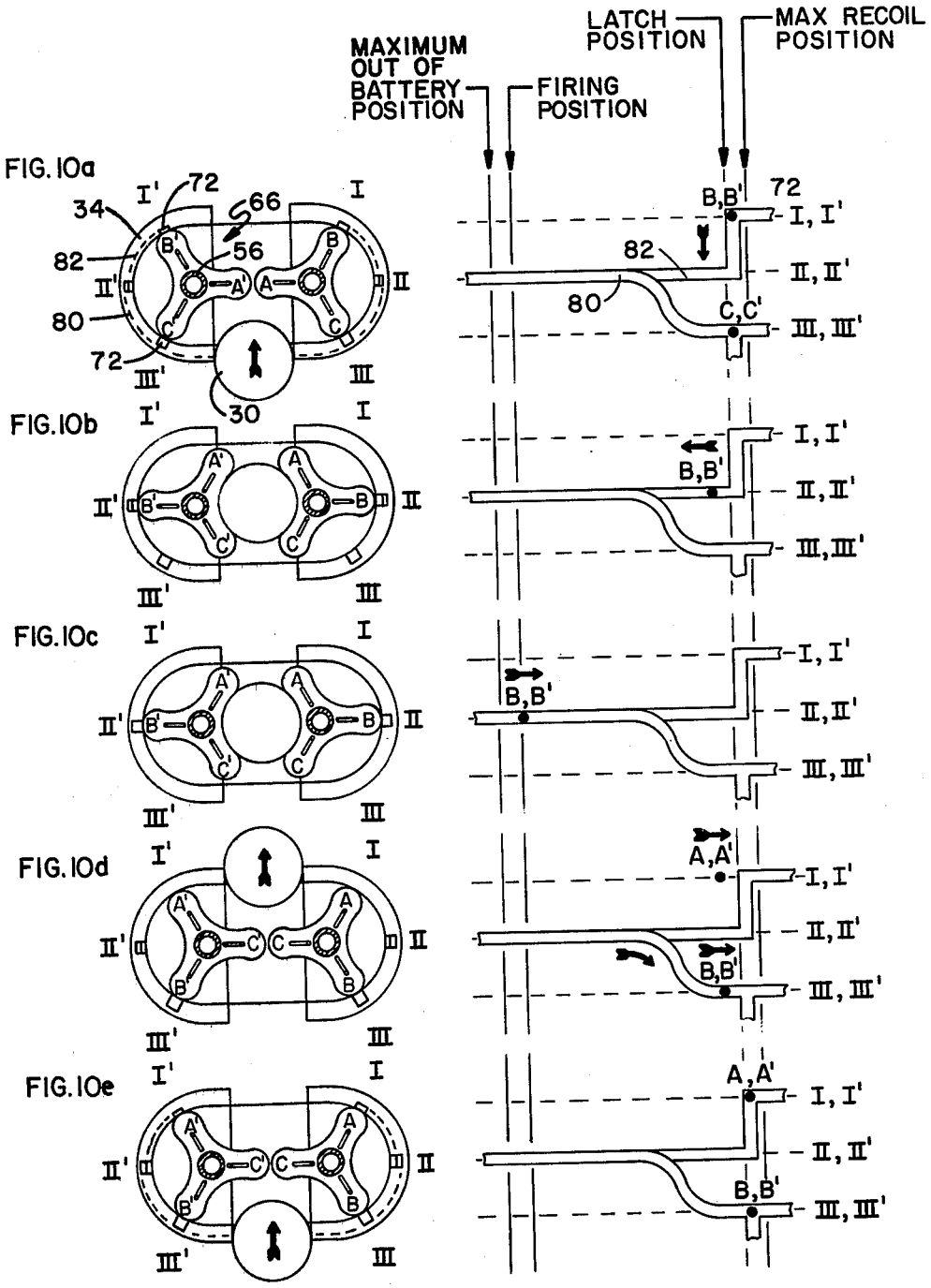
FIGS. 10(*a*)–(*e*) is a schematic representation of the motions of the breechcase mechanisms within the receiver assembly during each firing cycle.

A schematic of the motion of the receiver assembly 52 and the breechcase mechanism assembly 66 throughout the firing cycle is shown in FIG. 10. At the beginning of the cycle the receiver is held in the battery or latch position, and the breechcase mechanisms have the configuration shown in FIG. 10(*a*). In the following discussion, the terms "A," "B" and "C" rollers refer to the roller followers 72 mounted on each lobe of the trifurcate. The lobes marked A, B and C in FIG. 8 correspond to the positions A,A'; B,B' and C,C' in FIG. 10(*a*) and illustrate the followers 72 in the positions they assume in FIG. 10(*a*). In this position the "A" rollers are retracted while the "B" and "C" rollers are partially or fully extended. The "B" rollers in the "I" channel are blocked by the geometry of the channel from moving toward the firing position; this constitutes the latch mechanism which restrains the recoiling mass against the force applied by the recoil spring.

When the firing cycle is initiated, the clip feeder forces an expendable breechcase round 30 up into the firing position which is in axial alignment with the barrel. This action rotates the breechcase mechanism assemblies into the configuration shown in FIG. 15(*b*). The "B" rollers are transferred to the "II" channel which locks the breechcase in the firing position and releases the "latch," permitting the recoiling mass to accelerate toward the maximum out-of-battery position.

The deeper portions 80 of the cylindrical groove cams are indicated in FIG. 10. It can be seen that as the recoiling mass moves forward, the "B" rollers are free to snap out of the shallow portions 82 and into the deeper channels 80 under the influence of the extension springs 78. When the firing position is reached by the receiver, FIG. 10(*c*), a firing circuit is closed by a proximity switch and the subsequent firing impulse reverses the direction of motion of the recoiling mass.

As the mass moves back toward the position of maximum recoil, the "B" rollers are compelled to follow the curved path of the deeper track 80. This action rotates the breechcase mechanism assemblies into the configuration shown in FIG. 10(*d*), ejecting the now empty breechcase through the port in the top of the slide. Note that in this position the "A" rollers are aligned with the axis of the "I" channel, but they are held in a retracted position against the inside surface of the slide.

However, as the receiver moves slightly beyond the latch position to the position of maximum recoil, the "A" rollers extend under spring action into the "I" channel. When the force of the recoil spring has halted the rearward motion of the recoiling mass at the position of maximum recoil, it then returns the mass to the latch position as shown in FIG. 10(*e*). Here the extended "A" rollers and the geometry of the cylindrical groove cam prohibit, as before, any further forward motion of the recoiling mass. The configuration of the breechcase mechanism assembly in FIG. 10(*e*) is functionally equivalent to that of FIG. 10(*a*), and the cycle is complete. This cycle is repeated whenever a new round 30 is introduced by the clip feeder and aligned with the firing axis.

Figure 11:
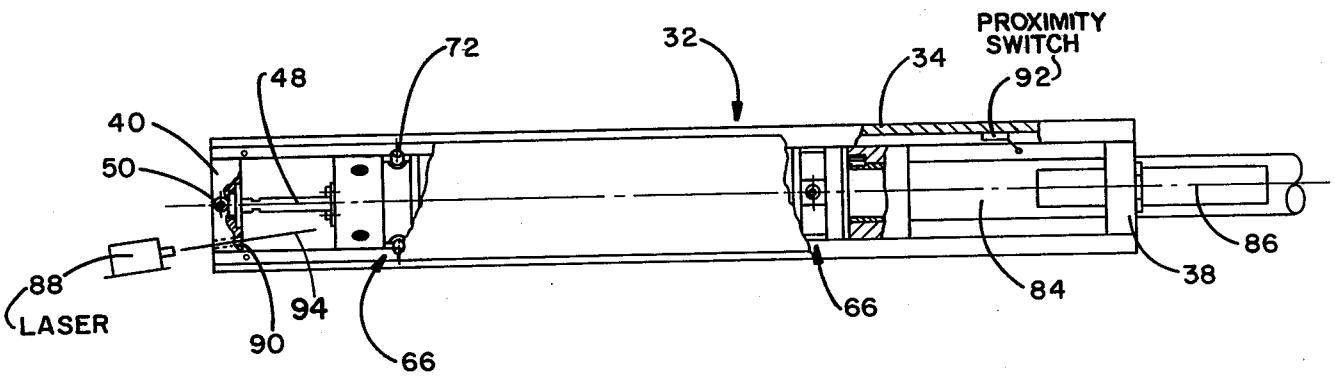
FIG. 11 is a view, partially in section, illustrating the receiver assembly disposed within the slide assembly and illustrating certain details of the firing circuit.

Attention now is directed to FIG. 11 wherein the receiver assembly 52 is shown within the slide assembly 32. A gun barrel 84 is mounted on the forward end of the receiver assembly. A pair of hydraulic buffers 86 are mounted on the front faceplate 38 of the slide assembly and serve to stop the receiver assembly and prevent damage to the gun in the event that a round fails to fire. A laser 88 is mounted on the frame adjacent the rear faceplate 40 which is provided with an aperture 90 to permit passage of the beam from the laser 88. A proximity switch 92, which may be of any suitable type, is mounted within the slide 34 between the receiver guides 46 for sensing arrival of the receiver assembly at the firing position. The proximity switch is connected through appropriate conventional circuitry (not shown) to the laser 88 and causes it to emit a firing pulse 94 each time the receiver reaches the firing position.

OPERATION

In order that a better understanding may be had, its mode of operation will now be described. In the operation of the gun system, expendable breechcase ammunition 30 (FIG. 3) is supplied to the gun mechanism from a feed mechanism 24 which is attached to and suspended beneath the gun as shown in FIG. 2. This feed mechanism, called the clip feeder, is hydraulically actuated and has a capacity of ten rounds. The clip feeder is replenished from a magazine 26 under the gun mount which contains a total of 220 rounds. On small craft this magazine would contain the complete allowance of ammunition for the gun, serving as both a ready service magazine and a storage magazine.

Inside the magazine 26 the rounds are stacked in a hexagonal array and are connected together by special wire links to form a chain, the chain of rounds being folded in the manner indicated by the dashed line in FIG. 2. The wire links are designed to permit rotation of the rounds relative to one another while transmitting the forces required to lift each round in turn to a magazine feeder assembly 28. The magazine feeder is part of the ammunition handling system. It serves to guide rounds into the clip feeder and cuts the links which join the rounds together. This system does not function while the gun is firing, but operates during the much slower handling cycle in which the clip feeder is loaded.

When preparing to fire, the gun is brought to zero degrees elevation. The magazine feeder 28 is raised to a position adjacent to the clip feeder 24 and the two assemblies are mechanically locked together. Hydraulic actuation of the clip feed mechanism forces rounds up through the magazine feeder and into the clip feeder. As the rounds pass through the magazine feeder the wire links are cut by means of an electric discharge (not shown); the separated link sections remain attached to the breechcase and are ejected with it after firing. When ten rounds have been advanced into the clip feeder, the magazine feeder is detached and retracted. The gun then elevates to lock on the target and is ready to fire. At this point from one to ten rounds can be fired with a rate variable from 1 to 240 shots per minute. That is, the operator can fire either ten rounds individually as desired or a burst of from one to ten rounds in length at any desired firing rate up to a maximum of 240 shots per minute.

The gun mechanism receives the rounds from the clip feeder, positions them during the firing cycle, and ejects the empty breechcases through the top of the gun after firing; all as described in connection with the description of FIGS. 10(*a*)–10(*e*). The spent breechcases are ejected up and to the rear through the ejection port 44 in the top of the gun, usually with enough momentum to carry them overboard. Their exit velocity can be controlled within specified limits by means of an elastomer buffer (not shown) attached to the ejection port and which would also serve as a weather shield.

The liquid spring system of FIG. 5, wherein various parts of the gun are shown schematically, provides the impetus which moves the receiver assembly toward the firing position by virtue of the force exerted by the pressurized silicone fluid on the ends of the shafts 56 through the follow pistons 48.

The gun mechanism is designed so that the latch mechanism of the FOOB recoil system is released by the mechanical action of feeding a new round into the gun mechanism. Although the gun and recoil mechanisms have a fixed cycle time, the actual firing rate of the gun depends on the amount of time delay permitted between the completion of the firing of one round and the initiation of the feed cycle for the next, up to the maximum rate. Thus the firing rate can be controlled by adjusting the hydraulic cycling rate of the clip feeder; this is accomplished automatically by the operator who can select the desired firing rate from a remote control panel.

The rounds are equipped with primers sensitive to the laser pulse 94 which results from closing of the proximity switch 92 in the firing circuit as the recoiling mass reaches the firing position. When all the rounds contained within the clip feeder have been expended, the gun is returned to zero degrees elevation and the clip feeder is automatically replenished as before. Since the magazine is suspended from the gun mount and rotates with the gun in train, it is necessary to adjust the gun only in elevation after reloading the clip feeder. A recovery time from two to six seconds, depending on the sophistication and complexity of the handling system, is estimated to be required for carrying out this procedure and engaging the same or a new target.

From the foregoing it will be readily apparent that the present invention provides a fully automatic and essentially self-contained unit which can be easily mounted on the main deck of any surface vessel having an armament payload equal to or greater than approximately 8000 pounds. The proposed gun mount, as depicted in FIGS. 1 and 2, exhibits an exceptionally low above-deck profile of 54 inches and extends below the deck only 72 inches. The base ring diameter of the mount is also only 72 inches. The invention features completely automated mount, feed, and handling systems which, in conjunction with the fire control system, require only a single operator remotely located with respect to the gun mount. An advanced lightweight modular fire control system can be selected to provide each craft type with accurate, reliable, all-weather performance commensurate with the mission task to be accomplished. On larger craft the system might include a coherent, frequency-agile, pulse doppler, monopulse tracking radar; a low light-level television with daylight capabilities; an infrared imaging systems for nighttime use; and a laser rangefinder. On smaller craft a more simplified electro-optical system, perhaps employing a laser radar, may suffice.

Another important advantage of the expendable breech concept derives from the fact that both the peak pressure and the peak thermal loading of the firing impulse can be designed to occur within the breechcase during the time the projectile is moving into the barrel. Since the bore pressure within the gun barrel itself is less than in the breechcase, the wall thickness of the barrel can be reduced. In addition, since the bore temperature is lower when bore pressure is lower and a large portion of the heat generated by each firing is expelled along with the spent breechcase, traditional problems such as barrel erosion and wear, cookoffs, etc., are either eliminated altogether or are minimized in the expendable breech gun. A new design tradeoff opportunity is provided by the expendable breech gun in that either a much higher firing rate may be achieved, or a hotter, more energetic propellant may be utilized without overheating the gun.

Obviously many modifications and variations of the present invention may occur to those skilled in the art in the light of the above teachings. For example, although the LSCGS has been described hereinbefore as a low velocity gun utilizing high/low interior ballistics, it is obvious that the principles of operation of the invention are equally applicable to the firing of high velocity ammunition of various kinds. The low velocity round described in the foregoing specification was selected primarily for the purpose of holding down costs during the initial development of the gun system. It is therefore to be understood that within the scope of the appended claims the invention may be practiced otherwise than as specifically described.

What is claimed is:

1. A light-weight, rapid-fire gun utilizing fire-out-of-battery and straight through ammunition feed principles for firing expendable breechcase ammunition comprising:

a frame:

a slide assembly trunion mounted on said frame, said slide assembly being provided with a pair of opposed feed and ejection slots;

a receiver assembly disposed within said slide assembly for reciprocating movement along the firing axis between an ammunition feed and breechcase ejection battery position and a forward firing out-of-battery position, said receiver assembly being provided with a central feed and ejection slot;

a pair of internal fixed hollow shafts disposed within said receiver assembly on axes parallel to and on each side of the firing axis, the forward ends of said shafts being closed;

a barrel fixed to the forward end of said receiver assembly and reciprocable therewith;

an indexing clip feed mechanism fixed to said slide assembly adjacent said feed slot for feeding expendable breechcase ammunition into said receiver assembly through said feed slot;

a breechcase mechanism assembly disposed within said receiver assembly for receiving ammunition from said clip feed mechanism, supporting said ammunition during firing, and subsequently ejecting empty breechcases through said ejection slot in said slide assembly;

recoil spring means on said slide assembly normally urging said receiver assembly forward toward the out-of-battery position, said recoil spring means comprising:

a pair of hollow pistons fixed to the rearward end of said slide assembly and disposed within with hollow shafts, and a source of pressurized compressible liquid hydraulically connected to the exterior ends of said pistons to constitute a liquid spring; releasable means for latching said receiver assambly in the battery position against the urging of said recoil spring means;

cam means interconnecting said receiver and slide assemblies for releasing said latching means upon injection of ammunition into said breechcase mechanism assembly and for cycling said breechcase mechanism assembly; and means for firing the ammunition as the forwardly moving receiver assembly nears the maximum out-of-battery position.

2. A gun as defined in claim 1 wherein said breechcase mechanism assembly comprises:

a pair of trifurcated members rotatably mounted on each of said shafts, the concave portions of each trifurcated member having radii of curvature substantially equal to the radius of curvature of the expendable breechcases; and slots formed in the sidewalls of said receiver assembly to accomodate the tips of said trifurcated members.

3. A gun as defined in claim 2 wherein said cam means comprises: cam followers mounted on the tips of said trifurcated members; and cylindrical groove cams formed in the interior walls of said slide assembly cooperable with said cam followers for cycling said breechcase mechanism assembly when said receiver assembly moves in recoil and counterrecoil.

4. A gun as defined in claim 3 wherein said pressurized source comprises:

a pressure vessel of substantial volume; and a variable delivery pump, said pump being servo-controlled to compensate for varying angles of elevation of the gun.

5. A gun as defined in claim 1 wherein said pressurized source comprises:

a pressure vessel of substantial volume; and a variable delivery pump, said pump being servo-controlled to compensate for varying angles of elevation of the gun.

* * * * *